United States Patent [19]

Clark, Jr. et al.

[11] 3,971,024

[45] July 20, 1976

[54] PROTECTIVE METAL SHIELD FOR PLASTIC FUZE RADOMES

[75] Inventors: Samuel A. Clark, Jr., Wheaton; George K. Lucey, Jr., Colesville, both of Md.; Thomas H. Zimmerman, Reston, Va.

[73] Assignee: The United States of America as represented by the Secretary of the Army, Washington, D.C.

[22] Filed: May 29, 1973

[21] Appl. No.: 364,576

[52] U.S. Cl. ..... 343/872; 102/70.2 P; 317/2 E; 343/885

[51] Int. Cl.[2] ..... H01Q 1/42; F42C 13/04

[58] Field of Search ..... 343/872, 841, 885; 102/70.2 P; 317/2, 2 E

[56] References Cited

UNITED STATES PATENTS

| | | | |
|---|---|---|---|
| 2,962,967 | 12/1960 | Bixby | 102/70.2 P |
| 3,089,421 | 5/1963 | Robinson, Jr. | 102/70.2 P |
| 3,780,661 | 12/1973 | Clark, Jr. | 343/872 |
| R25,417 | 7/1963 | Amason | 343/872 |

*Primary Examiner*—Maynard R. Wilbur
*Assistant Examiner*—Richard E. Berger
*Attorney, Agent, or Firm*—Nathan Edelberg; Robert P. Gibson; Saul Elbaum

[57] ABSTRACT

In combination with a plastic fuze radome, a structure for protecting the internal electronic components housed within said radomes during flight, said structure being a strap-on metal cap designed to slip on or over the ogive of the radome of a fuze. This metal cap is a metal cone having two open windows. The antenna of the fuze electronics is permitted to radiate through the windows while being protected from rain damage by the large umbrella at the top over the plastic nose cone, and from heat flux into electronic components by the large metal band at the bottom. Mechanical ablation of the tip is prevented by the cone of metal acting as a heat sink and as a shield against the wind-stream stagnation pressure. Triboelectric charging is prevented by two conductive straps down the side of the structure, and by a grounding electrical connection.

7 Claims, 1 Drawing Figure

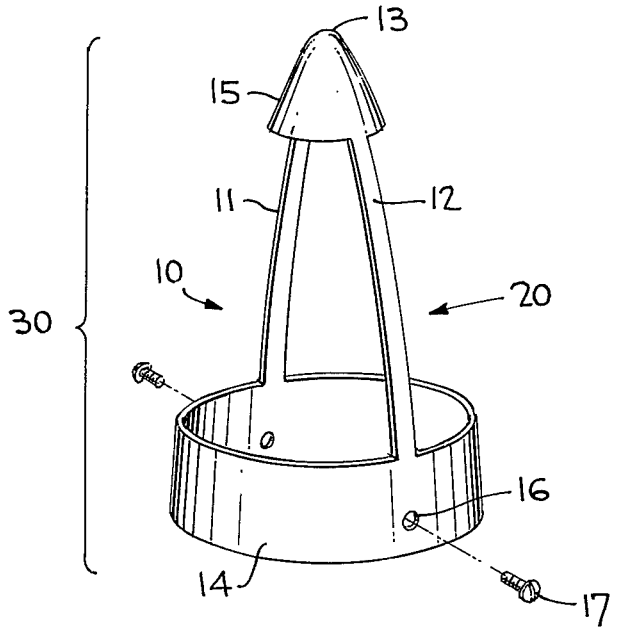
13
15
11
12
10
20
30
16
14
17
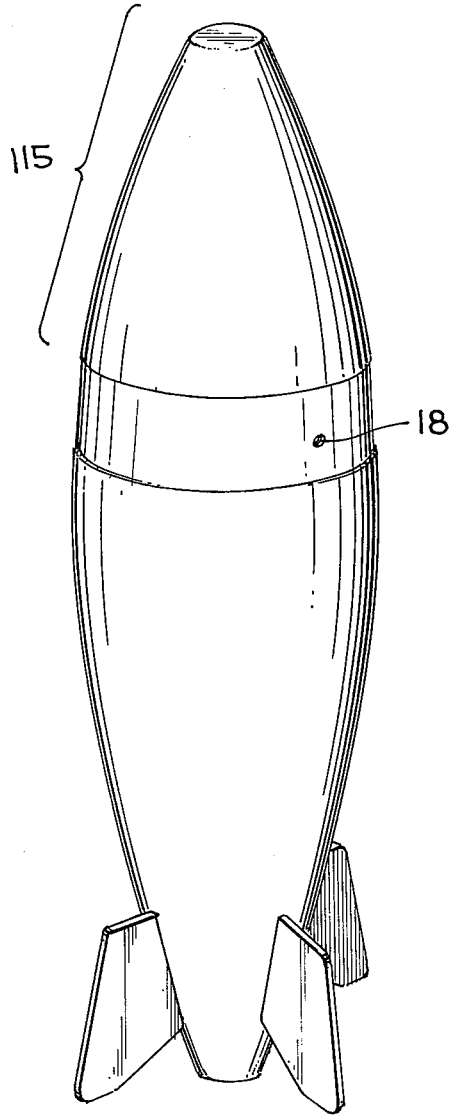
115
18

PROTECTIVE METALSHIELDFORPLASTIC FUZE RADOMES

RIGHTS OF THE GOVERNMENT

The invention described herein may be manufactured, used, and licensed for or by the United States Government for governmental purposes without the payment to the inventors of any royalty thereon.

BACKGROUND OF THE INVENTION

This invention relates generally to artillery fuze radomes which are used for a protective structure for the electronic components located in the nose of such a fuze. Specifically, this invention relates to artillery fuze radomes ordinarily made from thermoplastic material. This invention is specifically related to the class of thermoplastic radomes wherein a metal cap is used in combination with a thermoplastic protective structure for a fuze.

First, thermoplastics are used as a manufacturing material for these artillery fuze radomes because of their desirable electrical and mechanical properties, low cost, and amendability to mass production. A major problem with thermoplastics is their limited ability to protect the fuze during flight from the combined effects of aerodynamic heating, and erosion due to rain, dust, and other dense materials within the atmosphere. Erosion of the radome due to these solid materials and rain causes degradation of the accuracy of the electronic fuze mechanisms for range findings or other significant damage to the electronic components therein.

Different thermoplastic radomes exhibit varying deterioration rates when subjected to dust or rain impingement. This deterioration can be delayed somewhat by increasing the thickness of the radome tip. However, military specifications with regard to artillery fuze radomes do not allow sufficient material to be added to the tip in order to survive the complete flight profile from the foremost gunfire conditions. A valid means for protecting thermoplastic radomes from erosion and degradation is to use a metal cap. Heretofore, these caps have been designed such that they were interior to the radomes.

Another solution to the problems of erosion, ablation and also triboelectric charging is to design the radome to be as strong and thick as possible at the tip. Unfortunately, this approach is good only for velocities below 3,000 feet per second. Above these velocities the meatal cap is usually necessary. The cap is usually imbedded in the plastic for protection against heat and charging. The limitation with this design is that the umbrella cannot be very large due to interference with the fuze performance, hence a large amount of supporting plastic cannot be provided and rain is capable of undermining the cap.

The invention described herein overcomes many of the disadvantages of the foregoing constructions. It is therefore an object of this invention to provide a new and novel protective structure for internal fuze components. It is yet another object of this invention to provide a new and novel protective structure for internal fuze components in combination with a plastic fuze radome wherein said metal cap may be placed on the outer surface of the plastic fuze radome without interference with the electromagnetic radiation pattern from the fuze antenna.

It is yet an additional object of this invention to provide a new and novel protective structure for internal fuze components which may be placed on the outer surface of the plastic fuze radome and provide a large umbrella and in addition avoid triboelectric charging.

It is still an additional object of this invention to provide a protective metal strap-cap structure strapped to the outside of a plastic fuze radome which is capable of providing protection from mechanical ablation in addition to acting as a heat sink and a shield against windstream stagnation pressure.

SUMMARY OF THE INVENTION

A protective metal structure for internal fuze components in combination with a thermoplastic fuze radome comprising a metal cone having at least two windows therein and having at least two straps leading from the frontal portion of cone to a lower metal band which is a part of said metal cone. The cap is comprised of conductive metal and has windows cut therein for the purpose of permitting radiation from the electromagnetic antenna housed within the plastic radome. The frontal portion of said cone is designed to provide umbrella protection for the plastic tip located beneath.

BRIEF DESCRIPTION OF THE DRAWINGS

The specific nature of the invention as well as other objects, aspects, uses, and advantages thereof will clearly appear from the following descriptions and from the accompanying drawing which is a prospective illustration of the metal cap protective structure described herein.

These and other objects of the present invention will become more fully apparent with reference to the following specifications and the drawing which relate to a preferred embodiment of the present invention.

DESCRIPTION OF THE PREFERRED EMBODIMENT

The present invention will be easily understood in broad aspects by reference to the drawing wherein illustrated structure 30 may be mounted onto the fuze 115 by simply slipping it thereon applying the proper amount of pressure. This metal protective structure 30 is comprised of a hollow cone of metal generally shown at 30. The cone has a strap 14 at the base and a smaller conal structure 15 at the nose rounded tip 13. Connecting the lower strap 14 to the umbrella cone 15 are straps 11 and 12 located 180°apart. Straps 11 and 12 connecting the cone 15 to band 14 form windows 10 and 20 which are used for the purpose of permitting radiation from the antenna housed within the fuze 115 to be emitted. The fuze is permitted to radiate through the windows 10 and 20 while being protected from rain damage by the large umbrella cone 15 at the top, and from heat flux into the electronics by the large metal band 14 at the bottom. Mechanical ablation of the tip is prevented by the umbrella 15 acting as a heat sink and as a shield against the windstream stagnation pressure. Triboelectric charging is prevented by two conductive straps 11 and 12 down the side and by grounding electrical connection to the fuze body by means of screw 17 extending through hole 16 in the strap cap and being attached to the metal body of the fuze via metal hole 18 therein.

In testing this protective metal cap, a Van de Graff generator was used to charge a 105mm projectile to a voltage at which a Short Intrusion Fuze prefunctions.

The test was repeated with the strap-cap attached, and repeated again with a fuze that had a conductive coating. The results showed the strap-cap to be superior to the coated fuze, possibly because the rounded tip gives a lower corona onset than the blunt tip. The unprotected fuze was most sensitive to charging. Therefore, the strap-cap reduces or eliminates the following:

(1) Electrostatic corona discharge from the tip of the oscillator antenna; (2) Potential breakdown between capacitor gaps along the antenna loop; and (3) Capacitive coupling of the antenna to large windscreen surfaces having fluctuating potentials.

Protection against rain erosion was determined by mounting a Short Intrusion Fuze with a strap-cap attached onto a rocket sled and then firing the sled through an artificial rainfield. From this it was determined that the strap-cap protected the fuze in a rainfield that was not survived by a thermoplastic radome.

Aerodynamic heat transfer analysis of a 0.05 inch stainless steel plate protective cap mounted onto the tip of a blunt radome in comparison with an unprotected radome comprised of polyphenylene oxide with a 20% glass fill indicates that the protective metal cap significantly reduces the surface peak temperature of the plastic. Because of this particular feature of the protective metal cap herein a fuze equipped with the strap-cap may be fired at a higher gun velocity. Or, the plastic radome used in manufacturing the fuze may be comprised of and manufactured from a lower cost coarse thermoplastic having lesser heat resistance and mechanical characteristics. The feature of the protective metal cap which provides this superior performance and heat transfer is that heat flux into the metal portion 15 of the cap is reduced by the metal at the base of the strap-cap. This provides greater protection for the electronic components on higher velocity flights.

The cross sectional shape at the windows in the protective cone structure 30 are designed to provide as much emission from the antenna as possible. Generally, the shape of the windows should at least be congruent with the shape of the cross-sections for the fuze antenna cone patterns.

The inventor wishes it to be understood that he does not desire to be limited to the exact details of contruction shown and described herein for obvious modifications will occur to a person skilled in this art.

What is claimed is:

1. In combination with a thermoplastic fuze radome, a protective structure for internal fuze components comprising a conductive cap in contact with the forward surface of said radome, means for preventing relative movement of said cap and said radome, and means for allowing radiation to be emitted from the interior of said radome, wherein said cap is a hollow cone of sheet metal comprising an umbrella located at the nose thereof, means for reducing triboelectric charging located at the base thereof, and means for connection of said umbrella to said means for reducing triboelectric charging.

2. The protective structure of claim 1 wherein said means for allowing radiation to be emitted comprises at least one window located in the side of said cap.

3. the protective structure of claim 2 wherein said means for reducing triboelectric charging is a large metal band.

4. The protective structure of claim 3 wherein said means for reducing triboelectric discharging further comprises means for grounding said cap.

5. The protective structure of claim 4 wherein said means for connection is comprised of at least one metal strap.

6. The protective cap of claim 2 wherein said window has a shape congruent with the cross-sectional shape of at least one lobe of the antenna pattern from the fuze contained within the radome.

7. The protective cap of claim 6 wherein said umbrella has a rounded central outer tip.

* * * * *